US005783348A

United States Patent [19]

Tyagi et al.

[11] Patent Number: 5,783,348

[45] Date of Patent: Jul. 21, 1998

[54] METHOD OF FUSING TONER

[75] Inventors: Dinesh Tyagi, Fairport; Louis J. Sorriero; Muhammed Aslam, both of Rochester, all of N.Y.

[73] Assignee: Eastman Kodak Company, Rochester, N.Y.

[21] Appl. No.: 938,879

[22] Filed: Sep. 26, 1997

Related U.S. Application Data

[63] Continuation-in-part of Ser. No. 778,225, Jan. 8, 1997, abandoned.

[51] Int. Cl.[6] ..... G03G 13/20

[52] U.S. Cl. ..... 430/124

[58] Field of Search ..... 430/124

[56] References Cited

U.S. PATENT DOCUMENTS

| | | | |
|---|---|---|---|
| Re. 31,072 | 11/1982 | Jadwin et al. | 430/99 |
| 3,590,000 | 6/1971 | Palermiti et al. . | |
| 3,655,374 | 4/1972 | Palermiti et al. . | |
| 4,089,472 | 5/1978 | Siegel et al. | 241/5 |
| 4,323,634 | 4/1982 | Jadwin | 430/110 |
| 4,394,430 | 7/1983 | Jadwin et al. | 430/110 |
| 4,513,074 | 4/1985 | Nash et al. | 430/106.6 |
| 4,517,272 | 5/1985 | Jadwin et al. | 430/110 |
| 4,758,491 | 7/1988 | Alexandrovich et al. | 430/110 |
| 4,859,558 | 8/1989 | Matsumura et al. | 430/110 |
| 4,900,647 | 2/1990 | Hikake et al. | 430/137 |
| 4,921,771 | 5/1990 | Tomono et al. | 430/110 |
| 4,950,573 | 8/1990 | Yamaguchi et al. | 430/109 |
| 5,023,038 | 6/1991 | Aslam et al. | 264/293 |
| 5,047,305 | 9/1991 | Uchida et al. | 430/110 |
| 5,089,363 | 2/1992 | Rimai et al. | 430/45 |
| 5,118,588 | 6/1992 | Nair et al. | 430/110 |
| 5,126,225 | 6/1992 | Wilson et al. | 430/108 |
| 5,192,637 | 3/1993 | Saito et al. | 430/109 |
| 5,254,426 | 10/1993 | Aslam et al. | 430/124 |
| 5,256,507 | 10/1993 | Aslam et al. | 430/42 |
| 5,258,256 | 11/1993 | Aslam et al. | 430/124 |
| 5,378,572 | 1/1995 | Akiyama et al. | 430/110 |
| 5,536,352 | 7/1996 | Zeman et al. | 156/242 |

FOREIGN PATENT DOCUMENTS

| | | |
|---|---|---|
| 1442835 | 7/1976 | United Kingdom . |

*Primary Examiner*—Roland Martin

*Attorney, Agent, or Firm*—Doreen M. Wells

[57] ABSTRACT

In the fusing of an electrostatographic toner pattern to a receiver sheet such as paper or film, a selected degree of gloss or texture is imparted to the image by the use of thermoplastic toner particles having a surface energy less than 35 mN/m at 150° C. and a belt fusing system having a belt of a surface texture adapted to provide the selected degree of gloss or texture to the fused image, the belt having a surface energy of 35 to 70 mN/m at 150° C. and at least 5 mN/m at 150° C. greater than that of the toner particles.

14 Claims, 1 Drawing Sheet

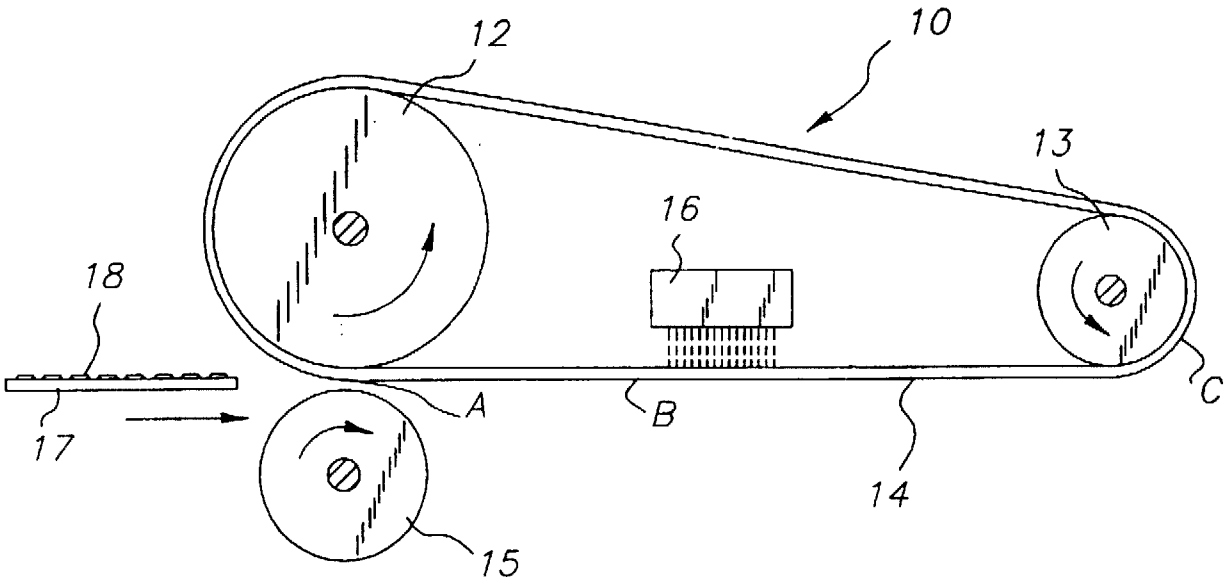
10
12
13
14
15
16
17
18
A
B
C

METHOD OF FUSING TONER

CROSS REFERENCE TO RELATED APPLICATIONS

This application is a Continuation-in-Part of U.S. patent application Ser. No. 08/778,225 filed Jan. 8, 1997 now abandoned.

FIELD OF THE INVENTION

This invention relates to the fusing of electrostatographic toner images. More particularly, it relates to a method for providing a selected degree of gloss or texture to thermally fused toner images.

BACKGROUND OF THE INVENTION

The fusing of thermoplastic dry toner powders to receiver sheets to form electrostatographic images or copies is well known in electrophotographic and dielectric recording processes. Either black and white or multicolor images can be formed by fusing such thermoplastic toners to receiver sheets. Two types of fuser systems have been used for applying heat and pressure to fuse the toner particles to the receiver, namely, fuser roller systems and fuser belt systems. A problem with fuser roller systems has been that the release temperature of the rollers is high. The toner then acts as a hot melt adhesive and can adhere the receiver sheet to the roller. One way to improve the release of the toner and receiver from the fuser roller is to apply a release oil to the roller. Release oils have, however, several disadvantages. Some of the release oil can remain with the fused image sheet and give the sheet an oily feel. It is also difficult to write on a sheet which has release oil on its surface and when the sheet is handled, fingerprints are readily seen. Release oils also tend to coat the inside of the electrostatographic machine and may affect the machine reliability. Further, the mechanical complexity of the oil delivery system affects the reliability of the machine.

It is also known to add low molecular weight polyolefins or functionalized fatty waxes to toner compositions to improve the release of toner from fuser rollers. These additives help provide release from the fuser roller surface if the fuser roller has low surface energy. When fuser rollers having high surface energy are used, the low molecular weight polyolefins or functionalized fatty waxes tend to coat the surface of the fuser roller which leads to roller failure. In addition to the toner release problems with fuser roller systems, it is also difficult with fuser rollers to form images having high gloss.

Fuser belt systems can reduce some of the problems encountered with fuser rollers. For example, as disclosed in the patent to Aslam et al., U.S. Pat. No. 5,258,256, the use of fusing belts or webs can produce glossy images. Fusing belts typically comprise a flexible metal band having a thermoset resin coating to provide for release of the toner from the belt. Unfortunately, the thermoset resin coatings cannot withstand the repeated flexing that a fuser belt undergoes in its cyclic movement, and this limits the useful life of the belt. Furthermore, the coating material is a polymer of low surface energy. This results in a smooth surface which limits the use of the belt to the forming of glossy images. It is desirable to be able to form images having either a glossy or a matte finish. A rough belt can give a matte finish, but has heretofore required a release oil (with the disadvantages mentioned above) to remove the toner image from the fuser belt.

There is a need, therefore, for a method of fusing toner images that does not require release oil to prevent the toner from sticking to the fusing means and that can provide toner images with either a glossy or a textured, non-glossy surface. This invention provides a method of fusing images which can produce fixed toner images having a selected degree of gloss by using fuser belts having selected textures. The word texture is used herein to describe the surface finish which is imparted to the finishing web or belt by controlling its surface roughness as well as the frequency of its topographical modulations. The method of the invention does not require release oils or release coatings on the fuser belt.

SUMMARY OF THE INVENTION

This invention provides a method for fusing and fixing an electrostatographic toner image to a receiver and imparting a selected degree of gloss and texture to the fused image, which comprises depositing toner particles on said receiver in an image pattern, said toner particles comprising a thermoplastic binder polymer and having a surface energy less than 35 mN/m at 150° C., providing a toner belt fuser system having a flexible fuser belt of a surface texture adapted to provide the selected degree of gloss and texture to the toner image, the surface energy of said belt being at least 5 mN/m at 150° C. greater than that of the toner particles, and preferably in the range from about 35 to 70 mN/m at 150° C., and heating and pressing said toner particles on said receiver by passing the receiver through said fuser system in contact with said fuser belt.

BRIEF DESCRIPTION OF THE DRAWINGS

The sole FIGURE of the drawing illustrates schematically a toner fuser belt system with which the method of the invention can be practiced.

DETAILED DESCRIPTION OF THE INVENTION

In the method of the invention, the surface of the fuser belt which contacts unfixed toner has a surface energy at least 5 mN/m at 150° C. greater than that of the toner and preferably, is in the range from about 35 to 70 mN/m at 150° C., and more preferably from 38 to 50 mN/m at 150° C. Surface energy is a measure of excess intermolecular forces experienced by the molecules present in the surface unlike the molecules in the bulk. The resulting differences in the force and the molecular packing can also be described as surface tension and can be measured by methods disclosed in *Physical Chemistry of Surfaces* by A. W. Adamson, 2nd Ed., Interscience, New York (1967) and *Polymer Surfaces* by B. W. Cherry, Cambridge University Press, Cambridge (1981). In the method of the invention a single fuser belt can contact the unfixed toner; however, more than one belt can be used. The belt can comprise metal, such as, nickel, aluminum or steel, or polymers such as, polyamide, polyesters and polyolefins. The fuser belt should be thick enough to be durable and thin enough to provide for heat transfer if heated from the backside. The fuser belt is free from release coatings such as thermoset resins which lower the surface energy to below 35 mN/m at 150° C. The fuser belt is preferably free from release oils, such as silicone oils, which also lower its surface energy. The fuser belt can be textured, e.g., by embossing, to provide fixed toner images having any desired gloss.

The structure of the belt fusing system can be of the same configuration as the belt fusing systems described in U.S. Pat. Nos. 5,258,256; 5,023,038 and 5,089,363, all of which are incorporated herein by reference, except that the fuser belt has the surface characteristics defined herein. The term belt is used in a broad sense herein to mean either a continuous belt or a spooled web, as disclosed in U.S. Pat. No. 5,089,363.

The toner used in the method of this invention has a surface energy of 10 to 35 mN/m at 150° C. and, more preferably, from 20 to 35 mN/m at 150° C. Such toners can be made by adding release additives to conventional toner compositions or by using polymer binders which form low surface energy toners in the absence of release additives, or both. Low surface energy toners containing release additives are known. For example, U.S. Pat. No. 4,513,074 discloses the use of waxes such as low molecular weight polyalkylene waxes in toner compositions; U.S. Pat. No. 3,655,374 discloses toner compositions containing metal salts of fatty acids; and U.K. Patent 1,442,835 discloses toner compositions containing a combination of fatty acids with polyalkylene compounds, such as polyethylene and polypropylene, to prevent toner offset. However, all of such toners are used in combination with a fusing roller of low surface energy.

In the method of the invention, when release additives are used in the toner composition, the polymer binders can include vinyl polymers, such as homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkyl acrylates or methacrylates. Fusible styrene-acrylic copolymers which are covalently lightly crosslinked with a divinyl compound such as divinylbenzene, as disclosed in U.S. Reissue Pat. No. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises a copolymer of a substituted vinyl aromatic monomer; a second monomer selected from the group consisting of conjugated diene monomers or acrylate monomers selected from the group consisting of alkyl acrylate monomers and alkyl methacrylate monomers; and a third monomer which is a crosslinking agent.

The toner binder polymers can be amorphous or semicrystalline polymers. The amorphous toner binder compositions useful in the method of the invention have a Tg in the range of about 45 to 120° C., and often about 50 to 70° C. The useful semi-crystalline polymers have a Tm in the range of about 50 to 150° C. and more preferably between 60 and 125° C. Such polymers can be heat-fixed to film supports as well as to more conventional substrates, such as paper, without difficulty. The thermal characteristics, such as Tg and Tm, can be determined by any conventional method, e.g., differential scanning calorimetry (DSC).

Preferred toner additives which can provide the desired low surface energy with binders such as described above include $C_8$–$C_{24}$ aliphatic amides, $C_8$–$C_{24}$ aliphatic acids, including metal salts of such aliphatic amides and aliphatic acids, diblock or triblock copolymer of styrene and ethylene-propylene blocks, $C_{12}$–$C_{30}$ aliphatic succinic anhydrides, hydroxy terminated polyethylene waxes having a number average molecular weight of 300 to 3,000, polypropylene waxes having a number average molecular weight of 5,000 to 15,000 and an aliphatic semicrystalline polyester having a $C_2$–$C_{12}$ acid component and a $C_2$–$C_{20}$ diol component. Suitable aliphatic amides and aliphatic acids are described, for example, in *Practical Organic Chemistry*, Arthur I. Vogel, 3rd Ed. John Wiley and Sons, Inc. N.Y. (1962); and *Thermoplastic Additives: Theory and Practice* John T. Lutz Jr. Ed., Marcel Dekker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ethylene bis(oleamide), ethylene bis(stearamide), ethylene bis (behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from about 0.5 to 30 percent by weight, preferably from about 0.5 to 10 percent by weight. Mixtures of aliphatic amides and aliphatic acids can also be used. One useful stearamide is commercially available from Witco Corporation as Kemamide S™. A useful stearic acid is available from Witco Corporation as Hysterene 9718™. Examples of other additives include polyolefin waxes such as Viscol® 660P and 550P polypropylene waxes available from Sanyo Chemicals, low molecular weight polyethylene waxes such as Polywaxes® and Unilins® waxes available from Petrolite Corporation, poly(decamethylene sebacate), metal stearates such as zinc stearate, Kraton® diblock or triblock copolymers available from Shell Development Company, and octadecyl succinic anhydrides. Typically, these additives are incorporated into the toner formulations during melt compounding either directly or via a dispersion, or to the limited coalescence process of making a toner via a dispersion, as disclosed in U.S. Pat. No. 4,883,060 which is incorporated herein by reference.

Low surface energy polymer binders which can be used without requiring the incorporation of release additives in the low surface energy toner compositions can be selected from a large number of polymers. Several such low surface energy binder polymers with their respective surface energies (all of which are below 35 mN/m at 150° C.) are listed in Table 1. Additional low surface energy binder polymers can be found in *Polymer Handbook*, J. Brandrup and E. H. Immergut, Eds, 3rd edition, Sect VI, pages 411–434, John Wiley & Sons, New York (1989). A mixture of two or more low surface energy binders can also be used and one or more low surface energy binders can be mixed with high surface energy binder or binders to provide a toner which has the required low surface energy.

TABLE 1

Surface Energy of Exemplary Binder Polymers

| Polymer Binder | Surface Energy (mN/m @ 150° C.) |
|---|---|
| Poly(tetrafluoroethylene) | 16.3 |
| Poly(dimethyl siloxane) | 18.0 |
| Polypropylene | 22.1 |
| Polyethylene | 29.4 |
| Poly(heptafluoro methacrylate) | 13.0 |
| Poly(t-butyl methacrylate) | 22.7 |
| Poly(iso-butyl methacrylate) | 23.1 |
| Poly(butyl methacrylate) | 23.5 |
| Poly(iso-propyl methacrylate) | 24.7 |
| Poly(methyl methacrylate) | 31.4 |
| Crystalline Polyesters | 30.0 |
| Poly(vinyl methyl ether) | 22.1 |
| Poly(vinyl toluene) | 27.5 |

TABLE 1-continued

Surface Energy of Exemplary Binder Polymers

| Polymer Binder | Surface Energy (mN/m @ 150° C.) |
|---|---|
| Poly(2-ethylhexyl methacrylate) | 20.8 |
| Poly(2-ethylhexyl acrylate) | 21.1 |
| Poly(butyl acrylate) | 24.6 |

Numerous dyestuffs or pigments can be employed as colorants in the toner particles. Suitable toners can be prepared without a colorant where it is desired to form toner images of low optical densities. Colorants can be selected from virtually any of the compounds mentioned in the *Colour Index* Volumes 1 and 2, Second Edition. For multicolor imaging, suitable colorants include those typically employed in primary subtractive cyan, magenta and yellow colored toners. Such dyes and pigments are disclosed, for example, in U.S. Reissue Pat. No. 31,072, which is incorporated herein by reference. A particularly useful colorant for toners to be used in black and white electrostatographic copying machines and printers is carbon black. The amount of colorant added may vary over a wide range, for example, from about 1 to 20 percent of the weight of binder polymer used in the toner particles. Good results are obtained when the amount is from about 1 to 10 percent. Mixtures of colorants can also be used.

Another component of the toner composition is a charge control agent. The term "charge control" refers to a propensity of a toner addendum to modify the triboelectric charging properties of the resulting toner. Charge control agents for either negative or positive charging toners are available. Suitable charge control agents are disclosed, for example, in U.S. Pat. Nos. 3,893,935; 4,079,014; and 4,323,634, all of which are incorporated herein by reference. Charge control agents are generally employed in small quantities such as, from about 0.1 to about 5 weight percent based upon the weight of the toner. Mixtures of charge control agents can also be used.

The toner can also contain other additives of the types used in previous toners, including magnetic pigments, leveling agents, surfactants, stabilizers, and other addenda well known in the art. The total quantity of such additives can vary but, preferably, are not more than about 10 weight percent of such additives on a total toner powder composition weight basis. In the case of MICR (magnetic ink character recognition) toners, however, the weight percent of iron oxide can be as high as 40% by weight.

The polymer binders can be melt blended with the addenda in a two roll mill or extruder. A preformed mechanical blend of particulate polymer particles, colorants and other toner additives can be prepared and then roll milled or extruded at a temperature sufficient to achieve a uniformly blended composition. For a polymer having a $T_g$ in the range of 50° C. to 120° C., or a $T_m$ in the range of 65° C. to 200° C., a melt blending temperature in the range of 90° C. to 240° C. is suitable using a roll mill or extruder. Melt blending times, that is, the exposure period for melt blending at elevated temperature, are in the range of 1 to 60 minutes.

The melt product is cooled and then pulverized to a volume average particle size of from 5 to 20 micrometers to yield the toner particles. It is preferred to grind the melt product before pulverizing it. The solid composition can be crushed and then ground using, for example, a fluid energy or jet mill, such as described in U.S. Pat. No. 4,089,472, and can then be classified in one or more steps.

The toner compositions can also be made with a process that is a modification of the evaporative limited coalescence process described in U.S. Pat. No. 4,883,060, cited above. This method of making toner particles is especially useful when the polymer binder has such toughness that it cannot be pulverized by conventional procedures, but can be dissolved in a solvent. To prepare toners for use in the method of the present invention the release additive is either dissolved or milled in the presence of a solution of the binder polymer so as to form a solution or dispersion of fine particles of the release additive in the binder polymer solution. This concentrate is then added to the remainder of the binder polymer solution and the process according to U.S. Pat. No. 4,883,060 is carried out. This produces binder polymer particles in which the release additive is uniformly distributed.

The toner can also be surface treated with small inorganic particles to impart powder flow or cleaning or improved transfer. The transfer assisting particles typically are smaller than 0.4 μm, preferably between about 0.01 and 0.2 mm, and most preferably about 0.05 to 0.1 μm. Preferred addenda are inorganic particles, but organic particles can also be used.

The toner image which is fused in the method of the present invention can be formed on the receiver by well known methods. Commonly, the toner is applied by means of a developer composition which can include a carrier and the described toner composition. Examples of carriers are disclosed, for example, in U.S. Reissue Pat. No. 31,072, cited above. Especially useful in magnetic brush development procedures are iron particles such as porous iron particles having oxidized surfaces, steel particles, and other "hard" and "soft" ferromagnetic materials such as gamma ferric oxides or ferrites of barium, strontium, lead, magnesium, or aluminum. Such carriers are disclosed, for example, in U.S. Pat. No. 5,248,339 and in the references cited therein, all of which are incorporated herein by reference.

Toner particles useful in the method of the invention have an average diameter in the range of about 0.1 to 100 μm, a value of about 2 to 20 μm being particularly useful in many current copy machines. The term "particle size" used herein means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

Surface energy of toner particles of the present invention were measured as follows. First a disk of the toner powder was produced by compression molding the toner powder in a mold at 10,000 psi at room temperature. Various surface imperfections and modulations present on the sample surface were removed by polishing the surface of the disk using a Buehler Ecomet 3 polisher available with a 600 grit grinding surface and a 0.05 micron polishing surface. The top surface of the slab sample was then exposed to 150° C. for two minutes. The surface energy was then measured by contact angle techniques, with diiodomethane and water as the liquids. The total surface energies are reported in mN/m for the toner samples in Table 2.

The 20° gloss levels for the final toner images formed in the method of the invention are in the range of 1 to 110. Such gloss levels are readily perceptible to the naked eye but can be measured by a specular glossmeter at 20°, for example, by the method described in ASTM 523–67. A typical method utilizes a single reflectivity measurement. For this measurement the amount of light from a standard source which is specularly reflected in a defined path is measured. A suitable device for this purpose is a Glossgard II 20° glossmeter, available commercially from Pacific Scientific Inc.

Various conductive or nonconductive materials can be used as supports or receivers for the toner images fused in the method of this invention. Well known supports include various metals such as aluminum and copper and metal-coated plastic films as well as organic polymeric films and various types of paper. Polyethylene terephthalate is an excellent transparent polymeric support for transparencies.

Finally, the selection of the fuser belt surface and the toner composition should be such that the surface energy of the toner is at least 5 mN/m at 150° C. lower than that of the fuser belt and the belt has a surface energy, preferably in the range from about 35 to 70 mN/m at 150° C. and most preferably from 38 to 50 mN/m at 150° C. When the difference between the toner and the fuser belt is less than 5 mN/m at 150° C., the resulting poor release of the toner from the belt surface reduces the belt life. In accordance with the invention, a surface energy difference of at least 5 mN/m between the toner and the belt fuser surface is maintained.

Fuser belts employed in the method of this invention can be of any size and can be used in any kind of fuser belt system. For example, the fuser belt system can comprise a fuser belt which is trained around two or more rollers, and is in pressurized contact with another fuser member, such as another fuser belt or a fuser roller. The drawing illustrates one suitable configuration for a fuser belt system 10 having a fuser belt 14. The fuser belt system 10 comprises a heating roller 12, and roller 13 around which fuser belt 14 is trained and is conveyed in the direction indicated on rollers 12 and 13. Backup roller 15 is biased against the heating roller 12. The fuser belt 14 is cooled by impinging air provided by blower 16 disposed above fuser belt 14. In operation, receiver 17 bearing the unfused toner 18 is transported in the direction of the arrow into the nip between heating roller 12 and backup roller 15, which can also or alternatively be heated if desired, where it enters a fusing zone A extending about 0.25 to 2.5 cm, preferably about 0.6 cm laterally along the fuser belt 14. Following fusing in the fusing zone A, the fused image then continues along the path of the belt 14 and into the cooling zone B about 5 to 50 cm in length in the region after the fusing zone A to roller 13. In the cooling zone B, belt 14 is cooled slightly upon separation from heating roller 12 and then additionally cooled in a controlled manner by air that impinges upon belt 14 as the belt passes around roller 13 and is transported to copy collection means such as a tray (not shown). Support 17 bearing the fused image is separated from the fuser belt 14 within the release zone C at a temperature where no toner image offset occurs. Separation is expedited by using a roller 13 of relatively small diameter, e.g. a diameter of about 2.5 to 4 cm. The length of time the toner image resides in each zone A, B and C can be controlled simply by adjusting the velocity of speed of belt 14. The velocity of the belt in a specific situation will depend on several variables, including, for example, the temperature of the belt in the fusing zone A, the temperature of the cooling air in the cooling zone B, and the composition of the toner particles.

In accordance with the present invention, fuser belt 14, on the side that contacts the toner 18, has a surface energy at least 5 mN/m at 150° C. greater than that of the toner and preferably is in the range from 35 to 70 mN/m at 150° C. Also in accordance with the invention, the surface texture or smoothness of belt 14 is selected to provide either a textured or a glossy finish for the fused toner image on receiver 17, and, in either event, good release of the fused image from belt 14 is achieved without the need for a release oil on the belt.

A valuable characteristic of the method of the invention can be described with reference to the drawing. As the drawing shows, the receiver sheet 7 remains in contact with belt 4 for a substantial length of time after the initial heating and fusing of toner in the nip between rollers 2 and 5. During the period of extended contact with the belt, the toner 8 on receiver 7 cools substantially. In the method of the invention, the toner of relatively low surface energy may contain a release additive such as a polyolefin wax of low melting point (Tm) or may have a low surface energy binder of low glass transition temperature (Tg). If such a toner is fused in a roller fuser the components of low Tm or low Tg are liquid or adhesive at the point of release from the roller nip and at least a portion thereof can stick to the fuser roller. In contrast, in the method of the invention, the fusing belt cools, e.g., to a temperature below about 75° C. and normally to about 30° to 60° C., and the receiver is released from contact with the fuser belt at a temperature below the melting point or Tg of any low melting release additive or low Tg binder of the toner. Being solid, the toner does not stick to the belt. This useful result is achieved in the method of the invention despite the fact that the fuser belt 4 has a relatively high surface energy, e.g., of 35 to 70 mN/m at 150° C. and even though its surface is textured.

The following preparation and fusing techniques and examples are presented to further illustrate this invention.

Comparative Examples 1 to 3 and Examples 1 to 19

Toners with and without low surface energy characteristics, used in the process of this invention were prepared by a conventional melt compounding and grinding process. The binder, charge agent, colorant and, in some cases, a low surface energy additive for release property, were melt compounded on a two roll mill at 150° C. The diameter of the rolls was 0.10 meters. A gap of 1.5 mm was used between the two rollers. The amount of polymer binder was in the range of 25 to 100 grams. Uniform shear conditions were maintained by controlling the dam width on the two roll mill. Higher shear conditions were created by lowering the temperature of one of the rollers after all the toner ingredients had been mixed into the toner melt.

The resulting melt slabs were coarse ground using a Wiley Mill™ apparatus from Thomas-Wiley Co., Philadelphia, Pa. The coarse ground powder was pulverized in a Trost TX jet mill at a rate of 1 gram/minute at 70 psi of air pressure. For all of the Examples and Comparative Examples, particle size of the resulting powder was between 8 and 15 micrometers volume average diameter as measured with a Coulter Counter. The compositions of the Examples and Comparative Examples are shown in Table 2. The percentage of binder in the toner composition is weight percent and the ratio shown within parentheses following the binder description is the molar ratio of the monomers of the copolymer. In every toner 1% by weight of dodecylbenzyl dimethyl ammonium 3-nitrobenzene sulfonate was used as the charge agent and they all contained 6% by weight of Black Pearls 430 carbon as the colorant. The latter is available from Cabot Corporation, Massachusetts. The only exception was in Comparative Example 2, where 10 percent by weight of aluminum phthalocyanine was used as the colorant and 1 percent by weight of Hodagaya's TP-415 was used as the charge control agent.

TABLE 2

| Toner | Binder | Additive | Surface Energy mN/m |
|---|---|---|---|
| Comparative Example 1 | 93% Styrene-butyl acrylate copolymer.(80/20) | None | 38.7 |
| Comparative Example 2 | 88% Styrene-butyl acrylate copolymer (80/20) | None | 39.2 |
| Comparative Example 3 | 93% Crosslinked Styrene-butyl acrylate copolymer (77/23) | None | 36.6 |
| Example 1 | 88% Styrene-butyl acrylate copolymer (80/20) | 5% Stearic Acid | 33.2 |
| Example 2 | 83% Styrene-butyl acrylate copolymer (80/20) | 10% Stearic Acid | 33.1 |
| Example 3 | 88% Styrene-butyl acrylate copolymer (80/20) | 5% Stearamide | 31.6 |
| Example 4 | 83% Styrene-butyl acrylate copolymer (80/20) | 10% Stearamide | 30.4 |
| Example 5 | 88% Styrene-butyl acrylate copolymer (80/20) | 5% Viscol 550P | 27.5 |
| Example 6 | 83% Styrene-butyl acrylate copolymer (80/20) | 10% Viscol 550P | 26.8 |
| Example 7 | 88% Styrene-butyl acrylate copolymer (80/20) | 5% Viscol 660P | 27.9 |
| Example 8 | 83% Styrene-butyl acrylate copolymer (80/20) | 10% Viscol 660P | 26.3 |
| Example 9 | 90.5% Styrene-butyl acrylate copolymer (80/20) | 2.5% Octadecyl Succinic Anhydride | 32.5 |
| Example 10 | 88% Styrene-butyl acrylate copolymer (80/20) | 5% Octadecyl Succinic Anhydride | 33.1 |
| Example 11 | 85.5% Styrene-butyl acrylate copolymer (80/20) | 7.5% Octadecyl Succinic Anhydride | 33.1 |
| Example 12 | 83% Styrene-butyl acrylate copolymer (80/20) | 10% Octadecyl Succinic Anhydride | 32.3 |
| Example 13 | 88% Styrene-butyl acrylate copolymer (80/20) | 5% Euracamide | 31.7 |
| Example 14 | 83% Styrene-butyl acrylate copolymer (80/20) | 10% Euracamide | 31.4 |
| Example 15 | 88% Styrene-butyl acrylate copolymer (80/20) | 5% Ethylene bis-Stearamide | 28.4 |
| Example 16 | 83% Styrene-butyl acrylate copolymer (80/20) | 10% Ethylene bis-Stearamide | 28.0 |
| Example 17 | 91% Styrene-butyl acrylate copolymer (80/20) | 2% Zinc Stearate | 26.8 |
| Example 18 | 89% Styrene-butyl acrylate copolymer (80/20) | 4% Zinc Stearate | 25.5 |
| Example 19 | 88% Styrene-butyl acrylate copolymer (80/20) | 5% Decamethylene Sebacate | 27.0 |
| Example 20 | 83% Styrene-butyl acrylate copolymer (80/20) | 10% Decamethylene Sebacate | 27.3 |
| Example 21 | 93% Styrene-isobutyl meth-acrylate copolymer (60/40) | None | 31.0 |
| Example 22 | 93% Poly(isobutyl methacrylate) | None | 25.1 |
| Example 23 | 93% Poly(isopropyl methacrylate) | None | 26.7 |
| Example 24 | 93% Methyl methacrylate - n-butyl methacrylate copolymer (33/67) | None | 30.1 |
| Example 25 | 93% Isobutyl meth-acrylate - heptafluoro methacrylate copolymer (90/10) | None | 26.5 |
| Example 26 | 93% Styrene - butyl acrylate - isobutyl methacrylate copolymer (44/6/50) | None | 28.7 |

All the toners described in Table 2 were tested in a belt fuser of the type described in U.S. Pat. No. 5,089,363 cited above. The belt fuser comprised one continuous belt which was mounted on two rollers, one of which was internally heated with an infra-red lamp. The pressure roller was located under the heated roller onto which the belt was mounted. Several different types of uncoated belt materials (all of which had surface energies greater than 35 mN/m at 150° C.) were used to provide different surface roughness and gloss to the fused image. The materials, surface roughness and surface energies of the belts are described in Table 3.

TABLE 3

| Fuser Belt | Belt Material | Surface Roughness (nm) | Surface Energy mN/m at 150° C. | Surface Energy mN/m |
|---|---|---|---|---|
| A | Nickel | 100 | 42.5 | 42.5 |
| B | Stainless Steel | 200 | 54 | 54.0 |
| C | Kapton ® Polyimide | 2000 | 49 | 49.0 |

The nip width with the selected configuration was 5 millimeters. The belt fuser was operated at the process speed of 38 millimeters per second. The nip temperature was varied between 115° C. and 150° C. to determine the optimum fusing conditions as well as to determine the fusing latitude with the toners. A subjective evaluation of the toner release properties was also carried out.

Results obtained with the various toners in the Comparative Examples and the Examples of the invention are summarized in Table 4.

TABLE 4

| Toner | Release Behavior | $G_{20}$ Gloss Belt A | $G_{20}$ Gloss Belt B | $G_{20}$ Gloss Belt C |
|---|---|---|---|---|
| Comp. Ex. 1 | No Release | Not applicable | Not applicable | Not applicable |
| Comp. Ex. 2 | No Release | Not applicable | Not applicable | Not applicable |
| Comp. Ex. 3 | No Release | Not applicable | Not applicable | Not applicable |
| Example 1 | No Hot-offset | 70 | 24 | 2.5 |
| Example 2 | No Hot-offset | 70 | 24 | 2.5 |
| Example 3 | No Hot-offset | 70 | 24 | 2.5 |
| Example 4 | No Hot-offset | 70 | 24 | 2.5 |
| Example 5 | No Hot-offset | 70 | 24 | 2.5 |
| Example 6 | No Hot-offset | 70 | 24 | 2.5 |
| Example 7 | No Hot-offset | 70 | 24 | 2.5 |
| Example 8 | No Hot-offset | 70 | 24 | 2.5 |
| Example 9 | No Hot-offset | 70 | 24 | 2.5 |
| Example 10 | No Hot-offset | 70 | 24 | 2.5 |
| Example 11 | No Hot-offset | 70 | 24 | 2.5 |
| Example 12 | No Hot-offset | 70 | 24 | 2.5 |
| Example 13 | No Hot-offset | 70 | 24 | 2.5 |
| Example 14 | No Hot-offset | 70 | 24 | 2.5 |
| Example 15 | No Hot-offset | 70 | 24 | 2.5 |
| Example 16 | No Hot-offset | 70 | 24 | 2.5 |
| Example 17 | No Hot-offset | 70 | 24 | 2.5 |
| Example 18 | No Hot-offset | 70 | 24 | 2.5 |
| Example 19 | No Hot-offset | 70 | 24 | 2.5 |
| Example 20 | No Hot-offset | 70 | 24 | 2.5 |
| Example 21 | No Hot-offset | 70 | 24 | 2.5 |
| Example 23 | No Hot-offset | 70 | 24 | 2.5 |
| Example 24 | No Hot-offset | 70 | 24 | 2.5 |
| Example 25 | No Hot-offset | 70 | 24 | 2.5 |
| Example 26 | No Hot-offset | 70 | 24 | 2.5 |

From the above results, it can be seen that when toners do not contain release additives or low surface energy binders, there is no release from the uncoated finishing belts. When toners of the Comparative Examples were passed through the belt fuser, not a single finished print could be obtained as they all adhered to the finishing belt. When toners of low surface energy were used in accordance with the present invention, prints were obtained without any indication of hot offset to the fuser belt surface. Further, by changing the roughness of the belt, it was possible to control the gloss of the finished image since the surface texture of the finished image is controlled by the imprint of the finishing belt.

Several different toners were fused in a belt fuser in accordance with the invention to evaluate the long term release performance. The results in Table 5 summarize the performance of these toners when multiple copies were run through the fuser with the uncoated stainless steel belt B at various temperatures. The tests were stopped at various points as there was no failure observed.

TABLE 5

| Toner | Toner Release Additive | Fusing Temp (°C.) | Number of Copies | Release from Belt |
|---|---|---|---|---|
| Example 18 | Zinc Stearate | 125 | 40,000 | Excellent |
| Example 8 | Viscol 660P | 125 | 16,000 | Good |
| Example 6 | Viscol 550P | 125 | 10,000 | Good |
| Example 4 | Stearamide | 125 | 2,800 | Good |
| Example 2 | Stearic Acid | 125 | 4,600 | Good |
| Example 12 | Octadecyl Succinic Anhydride | 125 | 650 | Excellent |
| Example 22 | None | 150 | 1,500 | Excellent |

All examples of Table 5 demonstrate that toner compositions which contain either release additives or a low surface energy binder can provide good fusing results in a belt fuser having a belt of high surface energy. In accordance with the invention, this combination of properties in a fuser belt system makes it possible to control the gloss of the image by selecting the surface roughness of the fusing belt.

The invention has been described with particular reference to preferred embodiments thereof but it will be understood that variations and modifications can be effected within the spirit and scope of the invention.

What is claimed is:

1. A method for fusing and fixing an electrostatographic toner image to a receiver and imparting a selected degree of gloss and texture to the fused image, which comprises depositing toner particles on said receiver in an image pattern, said toner particles comprising a thermoplastic binder polymer and having a surface energy less than 35 mN/m at 150° C., providing a toner belt fuser system having a flexible fuser belt of a surface texture adapted to provide the selected degree of gloss and texture to the toner image, the surface energy of said belt being at least 5 mN/m at 150° C. greater than that of the toner particles, and heating and pressing said toner particles on said receiver by passing the receiver through said fuser system in contact with said fuser belt.

2. A method according to claim 1 wherein the fuser belt is free from release oils and release coatings.

3. A method according to claim 1 wherein the toner has a surface energy of 10 to 35 mN/m at 150° C.

4. A method according to claim 1 wherein the fuser belt is an uncoated belt having a surface energy of 35 to 70 mN/m at 150° C.

5. A method according to claim 1 wherein the toner has a surface energy of 10 to 35 mN/M at 150° C. and the belt has a surface energy of 35 to 70 mN/m at 150° C.

6. The method according to claim 3 wherein the toner contains a release additive to achieve the surface energy of 10 to 35 mN/m at 150° C.

7. The method of claim 6 wherein the release additive is selected from $C_8$–$C_{24}$ aliphatic acids, $C_8$–$C_{24}$ aliphatic amines, metal salts of such aliphatic acids and aliphatic amines, diblock or triblock copolymer of styrene and ethylene-propylene blocks, $C_{12}$–$C_{30}$ aliphatic succinic anhydrides, hydroxy terminated polyethylene waxes having a number average molecular weight of 300 to 3,000, polypropylene waxes having a number average molecular weight of 5,000 to 15,000 and an aliphatic semicrystalline polyester having a $C_2$–$C_{12}$ acid component and a $C_2$–$C_{20}$ diol component.

8. The method of claim 6 wherein the release additive is 0.5 to 10 percent by weight of the toner binder.

9. The method of claim 6 wherein the release additive is selected from oleamide, eucamide, stearamide, behenamide, ethylene bis(oleamide), ethylene bis(stearamide), ethylene bis(behenamide), and stearic, lauric, montanic, behenic, oleic and tall oil acids, zinc stearate, polypropylene wax having a number average molecular weight in the range of 5,000 to 15,000, polyethylene wax having a number average molecular weight in the range of 300 to 3000, poly (decamethylene sebacate) having a number average molecular weight from 2,000 to 20,000 and octadecyl succinic anhydride.

10. The method of claim 1 wherein the toner binder polymer has a surface energy less than 35 mN/m at 150° C.

11. The method of claim 9 where the binder polymer has a number average molecular weight from 5,000 to 50,000 and is selected from the group consisting of poly(isobutyl methacrylate); poly(isopropyl methacrylate); copolymer of styrene, butyl acrylate and isobutyl methacrylate; copolymer of methyl methacrylate and heptafluromethacrylate; copolymer of isobutyl methacrylate and heptafluromethacrylate; and copolymer of methyl methacrylate and n-butyl methacrylate.

12. The method of claim 2 wherein the fusing belt has a textured surface.

13. The method of claim 12 wherein said fusing belt has a surface energy of 35 to 70 mN/m at 150° C.

14. The method of claim 1 wherein said toner particles contain a low melting release additive or a binder of low Tg and wherein the receiver is released from contact with the fuser belt at a temperature below the melting point of said low melting release additive or the Tg of said binder.

* * * * *